US007614323B2

(12) United States Patent
Warner

(10) Patent No.: US 7,614,323 B2
(45) Date of Patent: Nov. 10, 2009

(54) CORKSCREW FOR ONE HANDED OPERATION

(76) Inventor: Brent J. Warner, 2129 SE. 10th Ave. #8, Portland, OR (US) 97214

( * ) Notice: Subject to any disclaimer, the term of this patent is extended or adjusted under 35 U.S.C. 154(b) by 787 days.

(21) Appl. No.: 10/299,533

(22) Filed: Nov. 18, 2002

(65) Prior Publication Data

US 2003/0097910 A1 May 29, 2003

Related U.S. Application Data

(60) Provisional application No. 60/334,389, filed on Nov. 29, 2001.

(51) Int. Cl.
*B67B 7/04* (2006.01)

(52) U.S. Cl. ..... 81/3.47; 81/3.36; 81/3.45

(58) Field of Classification Search ..... 81/3.47, 81/3.35, 3.48, 3.09, 3.55, 3.36, 3.37, 3.39, 81/3.45, 3.29; 7/151, 154, 155
See application file for complete search history.

(56) References Cited

U.S. PATENT DOCUMENTS

| | | | | |
|---|---|---|---|---|
| 54,019 | A | 8/1866 | Swartz | |
| 74,199 | A | 2/1868 | Clapp | |
| 81,292 | A | 8/1868 | Ridgeway | |
| 207,631 | A | 9/1878 | Tucker | |
| 262,613 | A | 8/1882 | Pitt | |
| 280,697 | A * | 7/1883 | White | 81/3.37 |
| 793,318 | A | 6/1905 | Noyes | |
| 824,807 | A | 7/1906 | Noyes | |
| 850,184 | A | 4/1907 | Rees | |
| 891,260 | A | 6/1908 | Hutchinson | |
| 898,387 | A | 9/1908 | Noyes | |
| 984,661 | A | 2/1911 | Halk | |

(Continued)

FOREIGN PATENT DOCUMENTS

| | | |
|---|---|---|
| EP | 0041026 | 12/1981 |

(Continued)

OTHER PUBLICATIONS

Virtual Corkscrew Museum www.bullworks.net/virtual/vault/subito.htm Sep. 22, 2001.

*Primary Examiner*—D. S Meislin
(74) *Attorney, Agent, or Firm*—FSP LLC

(57) ABSTRACT

This invention relates to a corkscrew (1), of the first-class lever type, designed so that once the screw (3) is driven into a cork (10) that is fully inserted into the neck of a bottle (12) and that free end (8) of short fulcrum (5) is placed on the bottle lip (11), a single hand (14) can hold the bottle neck (12) and the free end (2') of the lever (2) simultaneously. A squeeze of one hand (14) will bring the free end (2') of lever (2) against the bottle neck (12). The cork (10) is now raised an initial distance from its original position. The operation is repeated using long fulcrum (6) whose free end (9) is placed against the bottle lip (11). In this second position the free end (2') of lever (2) and the bottle neck (12) are again within range of being grasped with one hand (14). A second squeeze of the hand (14) now moves the cork (10) the rest of the way out of the bottle neck (12).

8 Claims, 7 Drawing Sheets

U.S. PATENT DOCUMENTS

| | | | | |
|---|---|---|---|---|
| 1,058,049 | A | 4/1913 | Greenhut | |
| 1,213,034 | A | 1/1917 | Sowers | |
| 4,996,895 | A | 3/1991 | Puig | |
| 5,992,209 | A | 11/1999 | Puig | |
| 6,032,553 | A | 3/2000 | Puig | |
| 6,176,154 | B1 | 1/2001 | Puig | |
| 6,327,936 | B1 * | 12/2001 | Eguren | 81/3.47 |

FOREIGN PATENT DOCUMENTS

| | | |
|---|---|---|
| EP | 1132332 | 3/2001 |
| FR | 2689115 | 3/1993 |
| FR | 2770209 | 10/1997 |
| FR | 2803839 | 7/2001 |
| WO | WO0125133 | 4/2001 |

* cited by examiner

CORKSCREW FOR ONE HANDED OPERATION

CROSS-REFERENCE TO RELATED APPLICATION

This application claims benefit under 35 USC 119(e) of earlier filed U.S. Provisional Application Serial No. 60/334,389, filed 2001 Nov. 29.

BACKGROUND

1. Field Of Invention

This invention relates to manually operated corkscrews of the first-class lever type.

2. Description Of Prior Art

All previous corkscrews of the first-class and second-class lever types require two-handed operation, i.e. one hand to hold and stabilize the bottle and/or the fulcrum against the bottle, the other hand to apply an opening force.

Most pocket corkscrews are of the second-class lever type. A second-class lever places the load between a fulcrum, at one end of the lever, and a free end of the lever with which to apply a force. The load moves in the same direction as the applied force. In a corkscrew, this mode of operation lifts the cork out of the bottle in the same direction as the movement of the free end of the lever. The applied force moves the corkscrew lever away from the bottle. Hence this is an unstable procedure that requires use of two hands, one hand to stabilize the bottle and the fulcrum against the bottle lip and one hand to apply the force against the free end of the corkscrew. It also requires the use of both arms and shoulders, and some strength. This operation can be difficult for small people or those with physical limitations.

A seesaw is a first-class lever; a force at one end of the lever moves a load on the opposite end of the lever in the opposite direction to the applied force. Corkscrews of this type have been in use since the 1800s, but have not been popular for reasons that will be made apparent. The fulcrum is located between the screw and the applied force. The screw, at one end of the lever, is driven into the cork. Then the fulcrum is placed against the bottle lip. A force is applied downward on the free end of the lever. This results in the screw being lifted up, pulling the cork with it. The basic advantage to a first-class lever corkscrew is that the bottle can be placed on a stabilizing surface and the body weight becomes the applied force. Without placement on a stabilizing surface this operation can be more difficult than with a second-class lever corkscrew. This is because the body weight has nothing to push against except the strength of the operator, who must hold the bottle stable while applying a force that moves past the bottle rather than towards the bottle. Other disadvantages will be described later.

All previous pocket corkscrews have been designed for use with two hands; one to apply the force while the other hand holds the bottle stable and simultaneously holds the fulcrum in place. Only one prior art addresses the need or benefit of one-handed operation. Though U.S. Pat. No. 262,613 to Pitt requires only one-handed operation for removal of the cork, his device, using a direct pull, does not create any mechanical advantage. It also requires the bottle to be positioned on a table top or held in a second stabilizing hand. However, one-handed operation could be accomplished with a first-class lever corkscrew. The lever being shaped in a manner such that when a thumb is grasped around the bottle neck the free end of the lever is within the grasping range of the fingers of the same hand. Then, squeezing the grip will pull the free end of the lever towards the bottle and the screw end of the lever will be forced away from the bottle, extracting the cork. A very stable situation is created since only one body part, i.e. the hand, is used to move both the bottle and the free end of the lever towards each other, i.e. towards a common center-of-gravity. The fulcrum can be angled towards the screw at the bottle lip when the corkscrew is engaged for use, and is thus stabilized solely by being pushed towards its engagement with the bottle lip. Mechanical advantage can be added by utilizing fulcrums of different functional lengths. This will allow the cork to be raised less distance with each squeeze. Only one hand then is necessary to apply the force and hold both the bottle and the corkscrew stable during use.

First-class lever corkscrews with only one fulcrum require a large arc through which the lever must move to completely extract the cork. U.S. Pat. No. 280,697 to White, U.S. Pat. No. 984,661 to Halk and FR 2,770,209 to LeFebvre solve this problem by having multiple attachment points along the shank of the fulcrum to effectively create a set of multiple length fulcrums. U.S. Pat. No. 1,213,034 to Sowers uses multiple attachment points along the shank of the screw. U.S. Pat. No. 6,032,553 to Puig uses a complex ratchet design. In all of these the free end of the lever is to be held in a perpendicular, or an elevated position, relative to the bottle, allowing the person to use their body weight to press on the free end of the lever while stabilizing the bottle on a table top with the other hand and thus ruling out one-handed operation. The fulcrums are meant to be held against the bottle lip by the hand not applying the force.

First-class lever corkscrews are sensitive in two ways to the distance between the fulcrum's pivotal mount on the lever relative to the screw's pivotal mount on the lever.

1. The closer together the pivotal mounts of the fulcrum and screw are on the lever the more the free end of the lever points in a more elevated position when the corkscrew is engaged for use. As the pivotal mounts of the fulcrum and screw get further away the free end of the lever points lower when the corkscrew is engaged for use. The difference in lever position is large in just a few millimeters of relative pivotal mount displacement. The lever's angle relative to the bottle neck affects the convenience of use and the distance the cork is lifted with each movement of the lever.
2. As the fulcrum's pivotal mount point moves away from the screw's pivotal mount the fulcrum becomes more perpendicular to the screw. If the pivotal mounts become far enough away there will not be a lifting action of the screw but rather the screw will be pulled sideways, compressing the cork against the neck of the bottle. If the pivotal mounts get too close together the fulcrum will be driven off the bottle lip or the cork hardly moves at all.

Other problems with first-class lever corkscrews are:

1. Straight-out removal of the cork is difficult to achieve consistently as it is easy to misdirect the applied force and to translate the screw perpendicular to the desired direction, thereby compressing the cork against the bottle neck.
2. Getting the fulcrum to stay in place on the bottle lip during operation.
3. Creating mechanical advantage for ease of use.

The solution to the above problems has been to create a series of levering operations. This creates mechanical advantage, decreases sensitivity to the distance between the screw's and fulcrum's pivotal mounts and helps to keep the forces balanced so that the cork is lifted straight out from the bottle neck. FR 2,770,209 to LeFebvre accomplishes this with a fulcrum that has multiple attachment points along its shank. U.S. Pat. No. 1,213,034 to Sowers allows for changing the screw's length by allowing the attachment point along the shank of the screw to change. This creates a similar solution to LeFebvre. U.S. Pat. No. 6,032,553 to Puig uses a ratchet system which is complicated to use. The above solutions, except Puig, which still requires the use of a second hand to hold the fulcrum engaged with the bottle lip, require a lot of attention to keep the fulcrum on the bottle lip during the repositioning of the lever for each application of the force. They also work with the lever oriented perpendicular to the screw. This excludes one-handed operation. U.S. Pat. No. 984,661 to Halk, and U.S. Pat. No. 280,697 to White also utilizes multiple fulcrum attachment points but stabilizes the fulcrum by making its end an actual collar that goes over the bottle lip. This creates large and bulky fulcrums that cost extra to manufacture. The operator still needs to apply a considerable effort to change the respective attachment points smoothly. Again, they teach an elevated or perpendicular orientation of the lever to the screw that will require the use of two hands and a stabilizing surface.

Previous first-class lever corkscrews, U.S. Pat. No. 280,697 to White, sought to increase leverage by increasing the length of the corkscrew lever. This is satisfactory for a table-top model but does not solve the leverage problem for a pocket corkscrew.

The problem of the fulcrum staying in place has also been addressed by the following means. U.S. Pat. No. 850,184 to Rees recognized that a slight angle between the screw and fulcrum, that converges toward the screw at the bottle lip, would help hold the fulcrum in place. He only uses this offset angle to assist in holding the fulcrum in place as he also orients the lever perpendicular to the screw. This configuration, again, encourages the fulcrum to fall off the bottle lip and so two hands are required. U.S. Pat. No. 1,213,034 to Sowers uses a notch on the end of the fulcrum. The fulcrum will still fall off while changing the screw's attachment points, unless two hands and attention are given to the operation. Again he orients his lever perpendicular to the screw. U.S. Pat. No. 6,032,553 to Puig makes his fulcrum's ratchet system parallel to the screw, but the fulcrum still has to be held by a second hand since the screw is pivotally mounted and does not hold the fulcrum in place. The free end of his lever is also perpendicular to avoid pinching the operator's fingers on the hand holding the fulcrum in place. Additionally the lever is far from the grasp of a single hand. In summary:

1) second-class lever corkscrews do not allow for one-handed operation.
2) first-class lever corkscrews presently have the following disadvantages:
   a) Do not allow for one-handed operation.
   b) Have unstable or bulky means of keeping the fulcrum on the bottle lip.
   c) Are sensitive to the distance between the pivotal mounts of the fulcrum and screw on the lever.
   d) A straight-out pull on the cork is hard to achieve consistently.
   e) Leverage has been hard to increase without awkward means.
   f) The bottle needs to be stabilized with a hand and a support surface.

SUMMARY OF THE INVENTION

In its basic concept this invention comprises a corkscrew apparatus which pivotally mounts a cork-engaging screw on one end of a lever and pivotally mounts on the lever, between the screw end and the opposite free end of the lever, first and second fulcrums of different functional length which are arranged for sequential, seated engagement with a bottle lip. The lever is shaped so that the free end of the lever and the bottle neck can be held simultaneously in one hand, e.g. the thumb of a hand grasps the bottle neck while the fingers grasp the free end of the lever or the thumb can grasp the free end of the lever while the fingers grasp the bottle neck, when the screw is engaged within the cork and one of the fulcrums is engaged on the bottle lip. The engaged fulcrum converges toward the screw at the bottle lip and is held in place during use by the applied squeezing force. Whereby a one-handed squeezing operation, utilizing only two separate squeezes, will remove the cork from the bottle.

OBJECTS AND ADVANTAGES

Accordingly, the objects and advantages of my invention are:

(a) A corkscrew in which removal of the cork is accomplished by squeezing one hand. The operator does not need to use their arms and shoulders to apply any force; a significant mechanical advantage for small, one-handed, or otherwise physically limited people. The squeezing of one hand moves the bottle and the free end of the corkscrew to a common center of gravity, creating a very stable situation.

(b) The bottle need not be held stable with the other hand or by placement on a table top. Thus, even if the corkscrew and bottle assembly were held in mid-air by one hand during the opening process, the squeezing hand effectively holds both the corkscrew and bottle neck after the final squeeze of the corkscrew apparatus. This allows the free hand to be occupied elsewhere, such as putting on a show. Also, the stability gained in operation allows the bottle's label to be displayed prominently during opening.

(c) Leverage is gained with the use of multiple fulcrums of different functional length, further increasing the mechanical advantage and stability afforded by one-hand operation. This will make it easier to remove the tighter fitting plastic corks.

(d) The rotation of the screw's pivotal mount about the fulcrum's pivotal mount is balanced by a counter rotation of the fulcrum's pivotal mount about the fulcrum's engagement with the bottle lip due to the collapse of the lever against the bottle neck, creating a substantially straight up movement of the cork. The collapse of the lever against the bottle also enables the cork to be lifted the full distance of the fulcrum's length.

(e) A barbed spike can be used in place of a screw, allowing for total one hand use.

DESCRIPTION OF THE PREFERRED EMBODIMENTS

Figure 1:
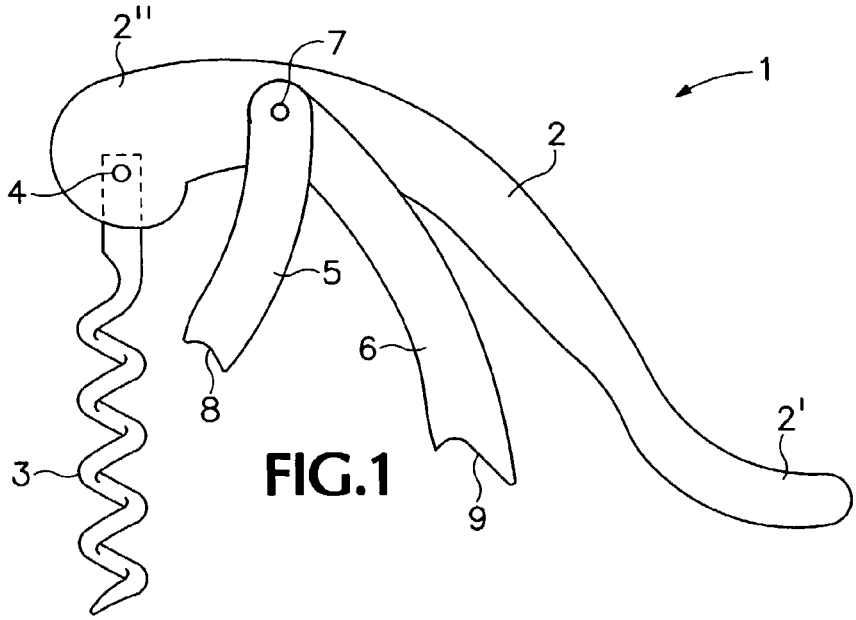
FIG. 1 is a side view of a corkscrew embodying features of this invention.
Figure 2:
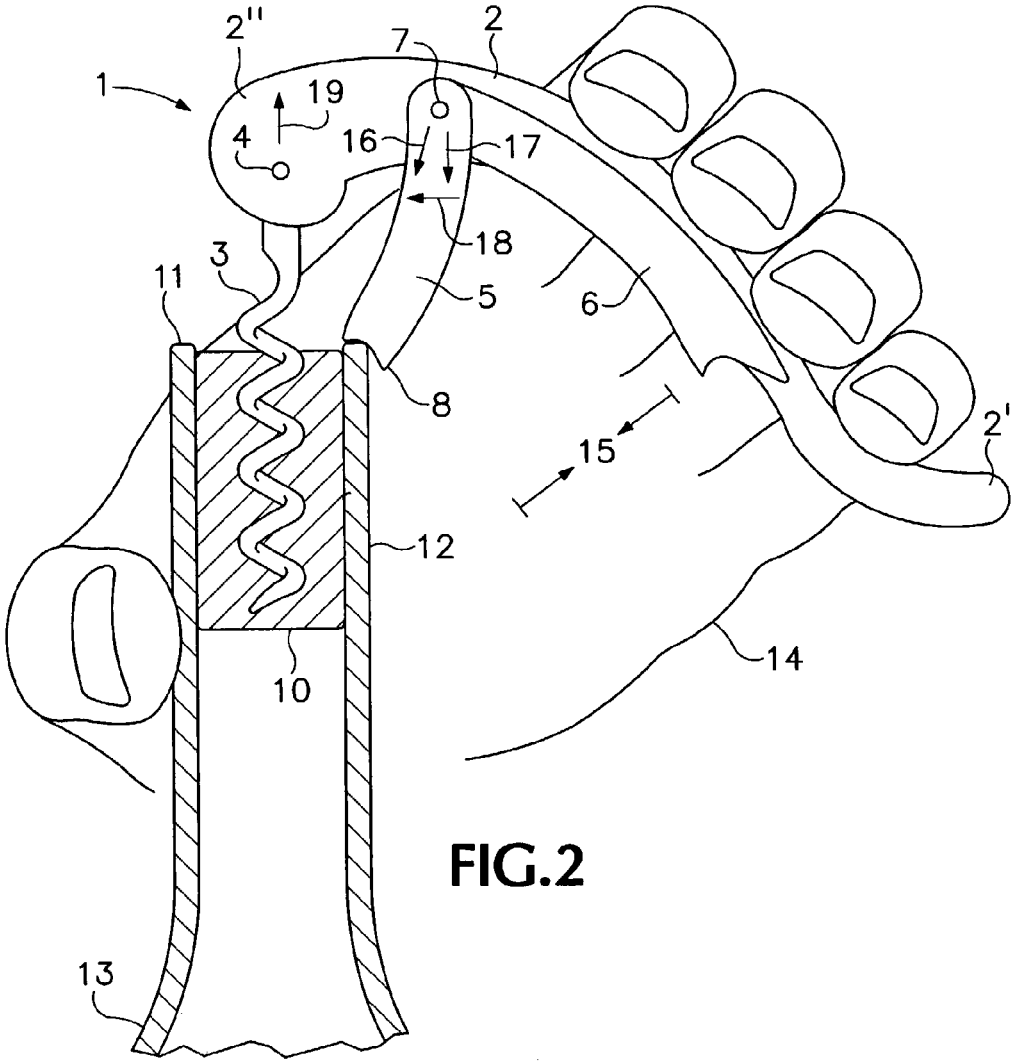
FIG. 2 is a side view of the corkscrew of FIG. 1 engaging a cork and bottle, utilizing the shorter fulcrum, prior to initial lifting operation of the corkscrew.

FIG. 1 is a side view of corkscrew (1) embodying features of the present invention. An elongated lever (2) has a shape configured to bring its free end (2') close to the neck (12) of a bottle (13) during use (FIG. 2). A cork-engaging screw (3) is pivotally mounted, by a pivot mount (4), on the opposite screw end (2") of the lever. A plurality of elongated fulcrums (5) and (6) are pivotally mounted, in this embodiment, by their ends with a common pivotal mount (7), intermediate the ends (2') and (2") of the lever (2) at a predetermined distance from pivot mount (4). Fulcrums (5) and (6) terminate in free ends (8) and (9) respectively that are configured to seat securely on the lip (11) of the neck (12) of the bottle (13) during operation of the corkscrew (1) (FIG. 2).

FIG. 2 shows the corkscrew apparatus with the screw (3) entirely engaged within a normal length cork (10) that is fully inserted within a bottle neck (12). When shorter fulcrum (5) is applied to the bottle lip (11), both the bottle neck (12) and the free end of lever (2) are within grasping distance of the thumb and at least one finger of one hand (14) as shown. Fulcrum (5) converges towards the screw (3) at the bottle lip (11) and as the hand (14) squeezes, force (15) is applied to the lever (2) and bottle neck (12). This results in force (16) at the fulcrum (5). Force (16) can be broken into a sidewards force (18) and a downwards force (17). Sidewards force (18) serves to force the free end of fulcrum (5) into a stable position on the bottle lip (11). Lifting force (19) is produced at the screw's pivotal mount (4). Fulcrum (5) includes a bottle lip-engaging seat on its free end (8) that creates a seating engagement on the bottle lip (11) when a force (16) is applied.

Figure 3:
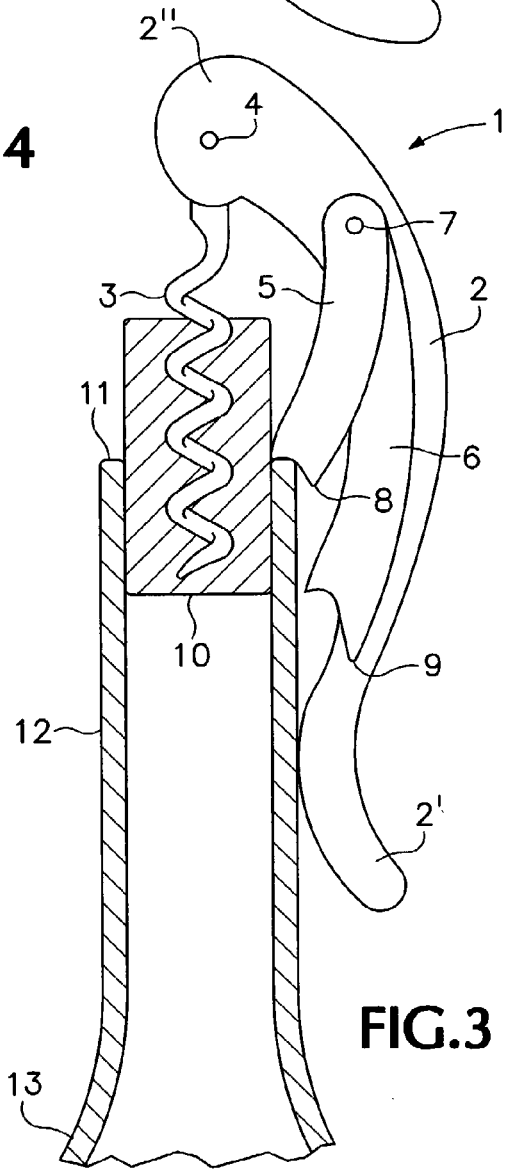
FIG. 3 is a side view similar to FIG. 2 but showing the corkscrew after operation using the short fulcrum.

FIG. 3 is a side view illustrating the position of the corkscrew apparatus (1) and cork (10) after the first complete squeeze of the lever (2). As described, only one hand is necessary to extract the cork (10) this initial distance since both the bottle (13) and free end (2') overlap and can both be held and supported by only that one hand.

Figure 4:
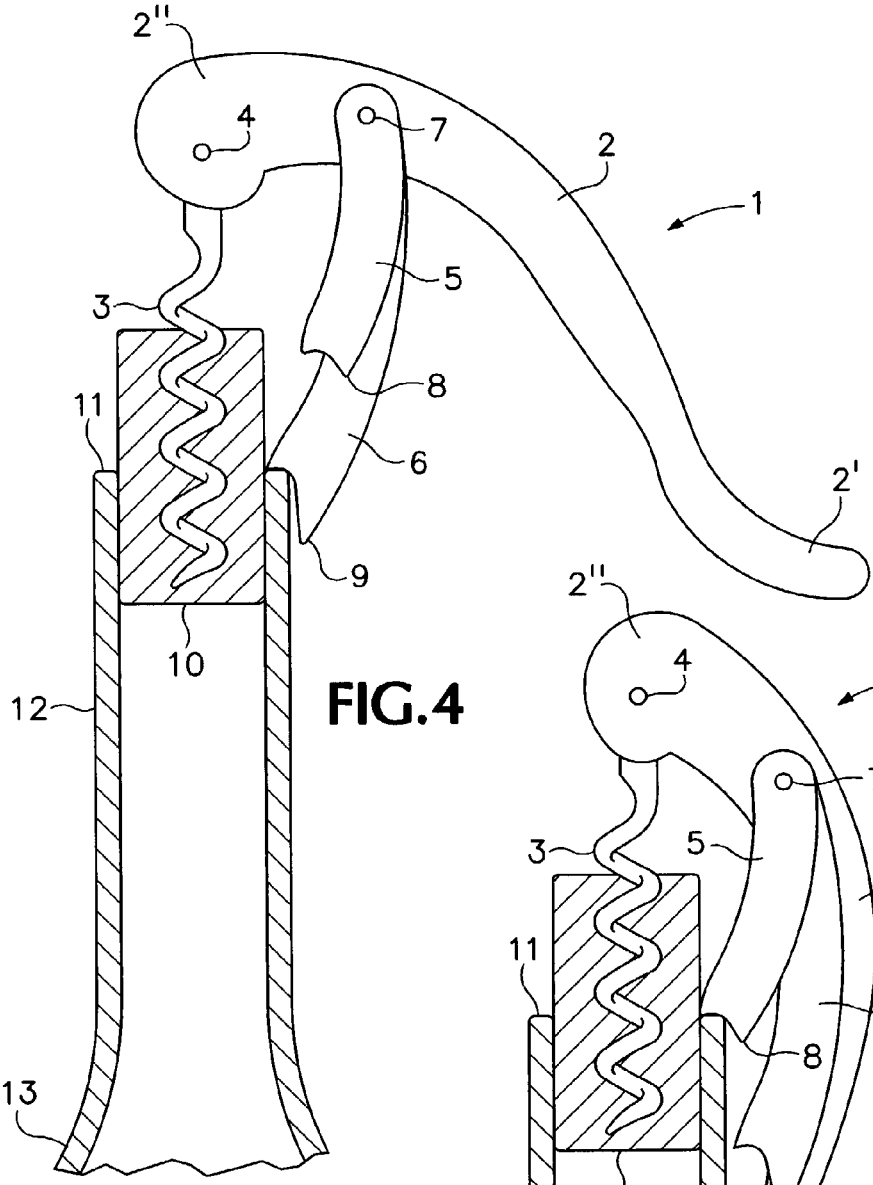
FIG. 4 is a side view of the corkscrew engaging the bottle with the longer fulcrum prior to operation of the corkscrew to lift the cork its final distance.

FIG. 4 is a side view of the corkscrew (1) after the first squeezing operation and now positioned with the longer fulcrum (6) engaged with the bottle lip (11). Since the first operation moved the cork (10), screw (3) and lever (2) vertically upward from the bottle lip (11), engagement of the longer fulcrum (6) on the bottle lip (11) repositions the lever's free end (2') at substantially the same angle from the neck of the bottle (12) as in the initial position when the shorter fulcrum (5) was engaged. The thumb may now have to move up the neck of the bottle (12), but is still able to hold it securely. Fulcrum (6) again converges towards the screw (3) at the bottle lip (11), and when a squeezing force is applied, a force similar to force (16), will be produced that will hold the fulcrum (6) against the bottle lip (11). Fulcrum (6) also has a bottle lip-engaging seat on its free end (9) that creates a seating engagement with the bottle lip (11) when a squeezing force is applied to the lever as described before.

Figure 5:
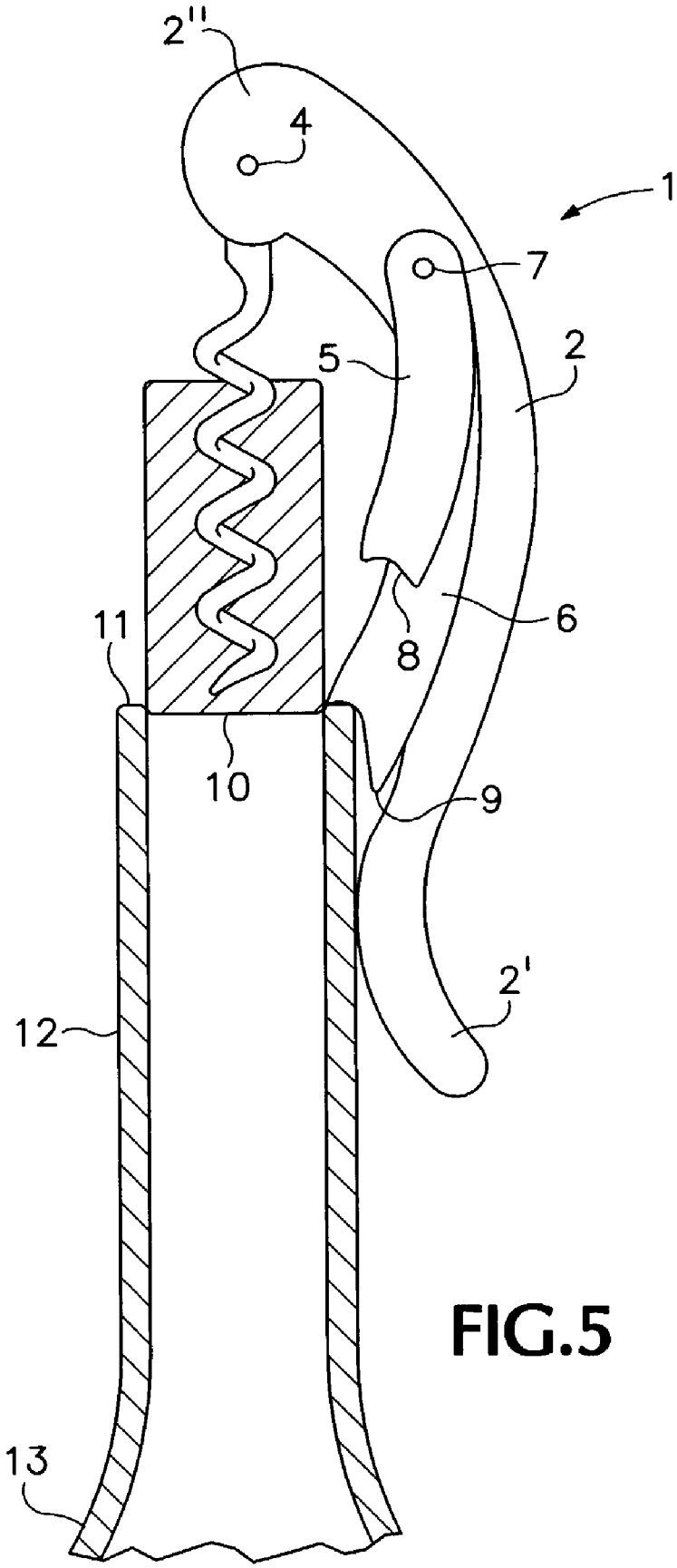
FIG. 5 is a side view illustrating the position of the cork and the corkscrew after its second and final squeezing operation.

FIG. 5 is a side view of the corkscrew (1) after the final squeeze. Cork (10) is extracted from the bottle (13) and since the free end (2') overlaps the bottle neck (12) both the corkscrew (1) and the bottle (13) are held stable with only the squeezing hand. It can be seen that the depth to which the screw (3) is driven has an effect on how far the cork (10) is extracted from the bottle. This depth can be gauged by the user to either leave a little bit of the cork (10) in or to completely remove cork (10) from the bottle neck (12).

Figure 6:
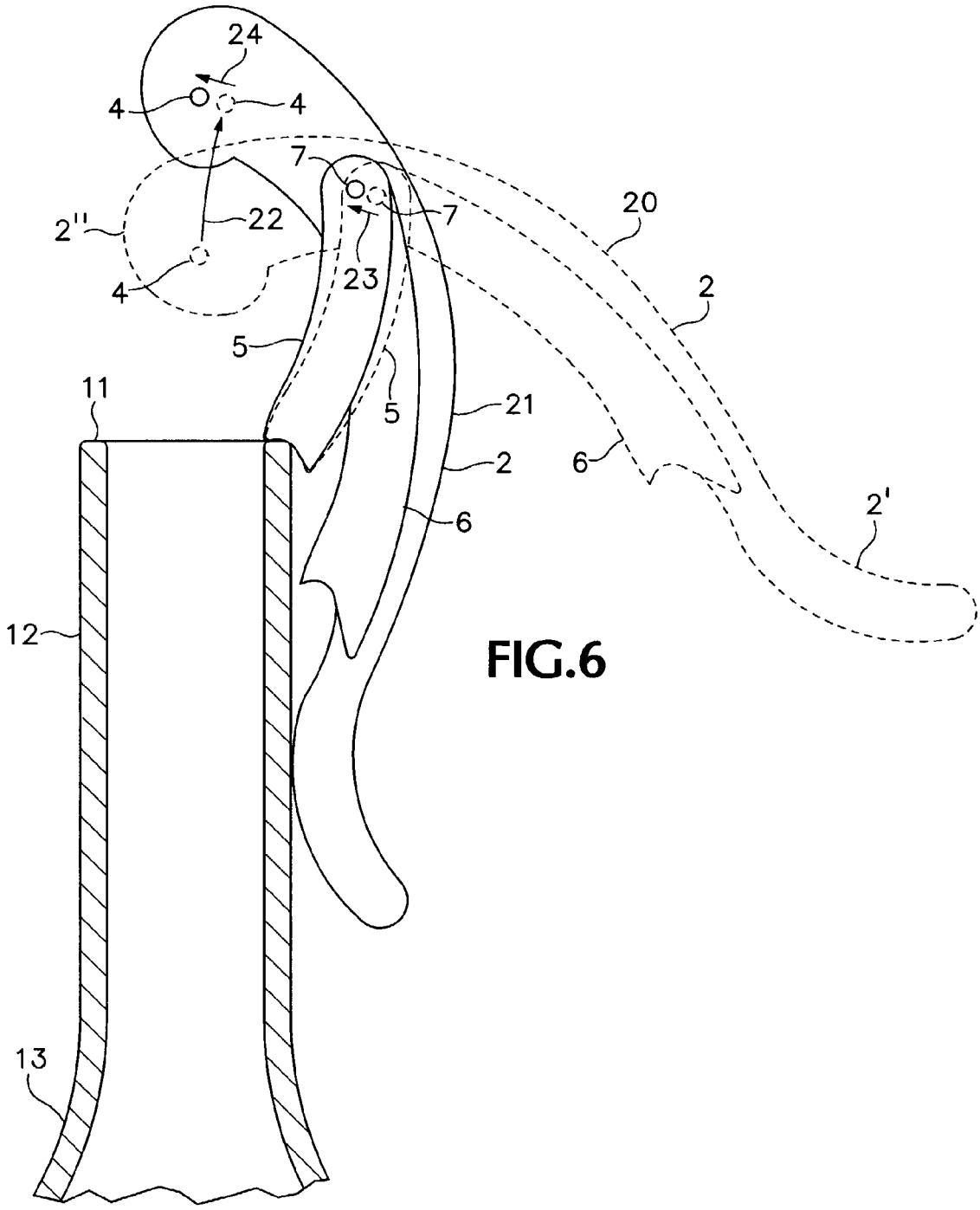
FIG. 6 is a side view illustrating the motions of the pivotal mounts of the screw and fulcrums during operation of the corkscrew.

FIG. 6 illustrates the operative movement of the corkscrew apparatus during squeezing operation. The dashed corkscrew (20) represents the corkscrew's initial position before the squeezing operation and the solid corkscrew (21) represents the corkscrew's position after the squeezing operation. Arrow (22) illustrates what the displacement of pivot mount (4) about pivot mount (7) would be if the fulcrum (5) was fixed in place. Since the fulcrum (5) is not fixed in place, arrow (23) illustrates the movement of pivot mount (7) as the corkscrew collapses against the bottle neck (12) during operation. Arrow (24) illustrates the movement of pivot mount (4) that results from the movement (23) of pivot mount (7). Together movements (22) and (24) of pivot mount (4) result in pivot mount (4) being in a position which is substantially straight-up from its initial position.

In the operation of the corkscrew (1), the screw (3) is threaded into a cork to a desired depth. The shorter fulcrum (5) is positioned first, with its bottle lip-engaging free end (8) supported on the bottle lip (11). The bottle neck (12) is grasped with thumb of hand (14) and the free end (2') of lever (2) is grasped by at least one of the fingers of hand (14) as illustrated in FIG. 2. The free end (2') is squeezed towards the bottle neck (12) until the free end (2') is pressed against the bottle neck (12) and cork (10) is lifted as fully as this motion allows, FIG. 3. Fulcrum (5) is disengaged from the bottle lip (11) and long fulcrum (6) is positioned with its bottle lip-engaging free end (9) engaged with the bottle lip (11) as shown in FIG. 4. The free end (2') is again squeezed as before until it is again against bottle neck (12), FIG. 5. The cork (10) will either be fully extracted or left partially in, depending on the depth the operator chose to drive the screw in. During this operation the bottle (13) does not need to be stabilized at all. If the cork (10) is fully extracted while the bottle (13) is held in midair without any support other than the corkscrew (1) and one squeezing hand, lever (2) will abut and overlap the bottle neck (12), allowing the single hand to hold both the bottle neck (12) and corkscrew (1) and keep the bottle (13) from falling FIG. 5.

In the operation, squeezing the free end (2') towards the bottle neck (12) rather than applying the force downward parallel to the bottle (13) results in a straight-up lift of the cork (10) as described in FIG. 6.

Figure 7:
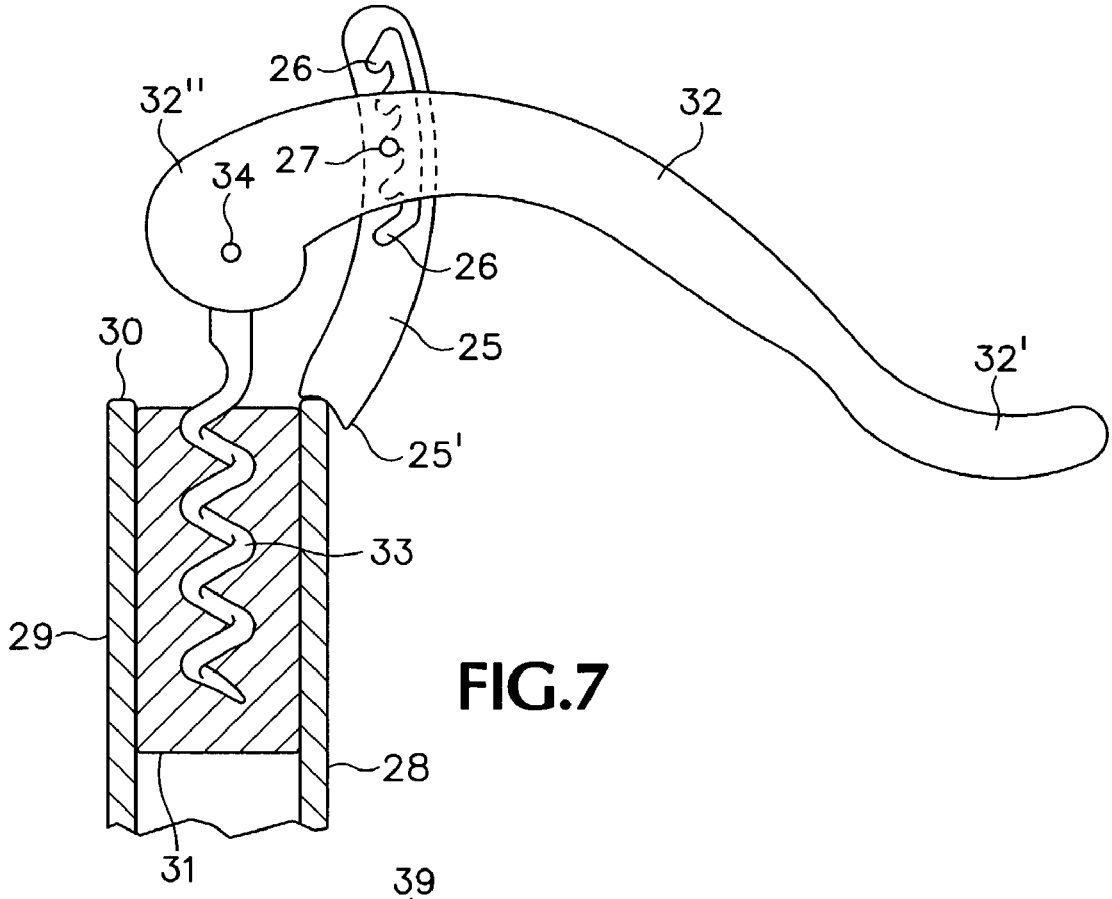
FIG. 7 is a side view of another embodiment of a corkscrew of this invention having a single fulcrum that is adjustably and pivotally mounted to the lever.

FIG. 7 illustrates another embodiment of this invention utilizing a single fulcrum member (25) with multiple pivotal attachments points (26) configured to engage a pivot mount (27) to adjustably connect fulcrum (25) to lever (32) between screw end (32") and an opposite, free end (32'). A cork engaging screw (33), pivotally mounted (34) at screw end (32") of lever (32), is driven into a cork (31) in a bottle (28). The free end (25') of fulcrum (25) is engaged with the bottle lip (30), and a fulcrum pivotal attachment point (26) is chosen so that free end (32') and the bottle neck (29) are within the grasp of a single hand as shown in FIG. 2 previously. The free end (32') is squeezed against the bottle neck (29) lifting the cork (31) an initial distance. Subsequent pivotal attachment points (26) are chosen for the grasping convenience of a single hand and the squeezing operation is repeated until the cork (31) is removed.

Figure 8:
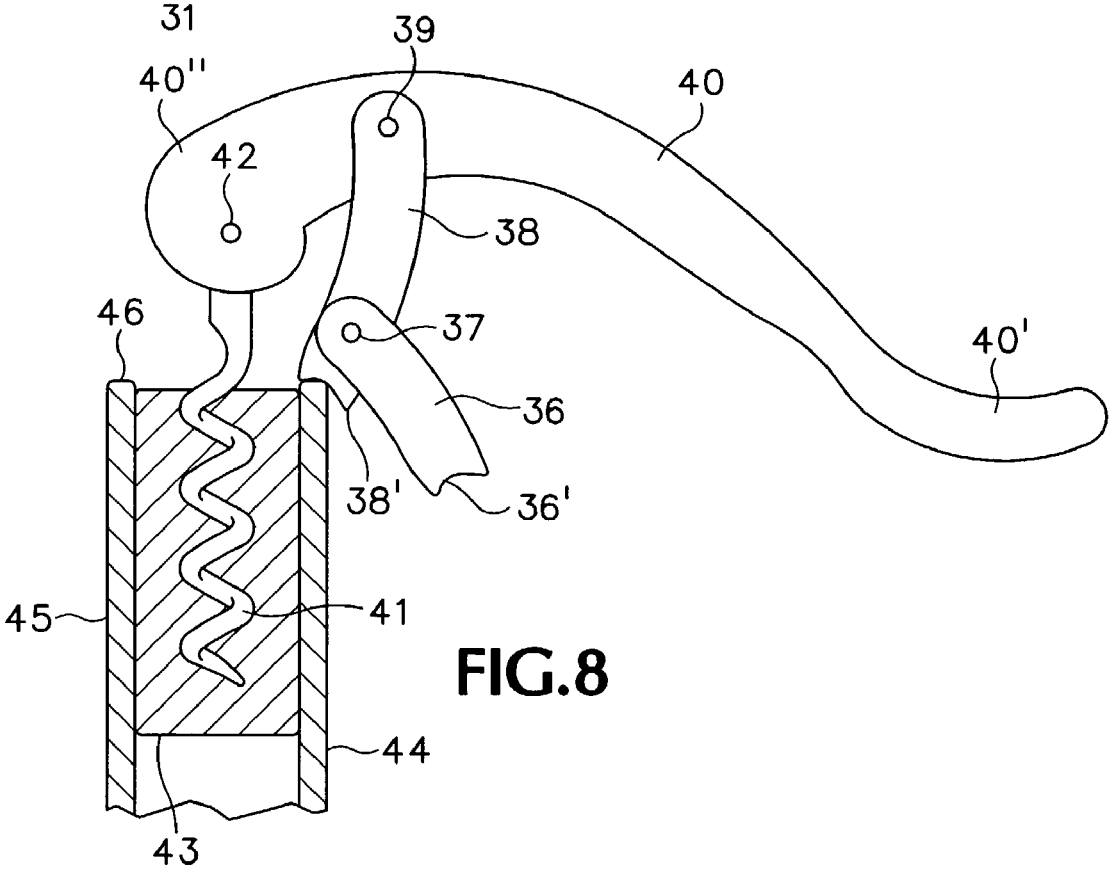
FIG. 8 is a side view of another embodiment of a corkscrew of this invention having two fulcrums where one is attached pivotally, but with limitations, to the end of the other.

FIG. 8 illustrates another embodiment of this invention where a distal fulcrum (36) is pivotally mounted (37) to the free end (38') of a proximal fulcrum (38) that is mounted by pivot (39) to a lever (40) between a screw end (40") and a free end (40'). A cork-engaging screw (41) is pivotally mounted (42) to the screw end (40") of the lever (40). During use, the screw (41) is driven into a cork (43) in a bottle (44). The free end (40') and bottle neck (45) are positioned within the grasp of a single hand, similar to FIG. 2, when the free end (38') of proximal fulcrum (38) engages the bottle lip (46) during the first operation. A squeeze of the operator's hand will bring the free end (40') against the bottle neck (45) and the cork (43) will be lifted an initial distance. Subsequent pivoting of distal fulcrum (36) on pivot mount (37) into a condition extending axially from proximal fulcrum (38) and engagement of free end (36') of distal fulcrum (36) against the bottle lip (46) will again place the free end (40') and bottle neck (45) within the grasp of a single hand. Another squeeze as described before will remove cork (43) from the bottle neck (45). Distal fulcrum (36) has a limited rotational range on proximal fulcrum (38) preventing the fulcrum system from collapsing during use.

Figure 9:
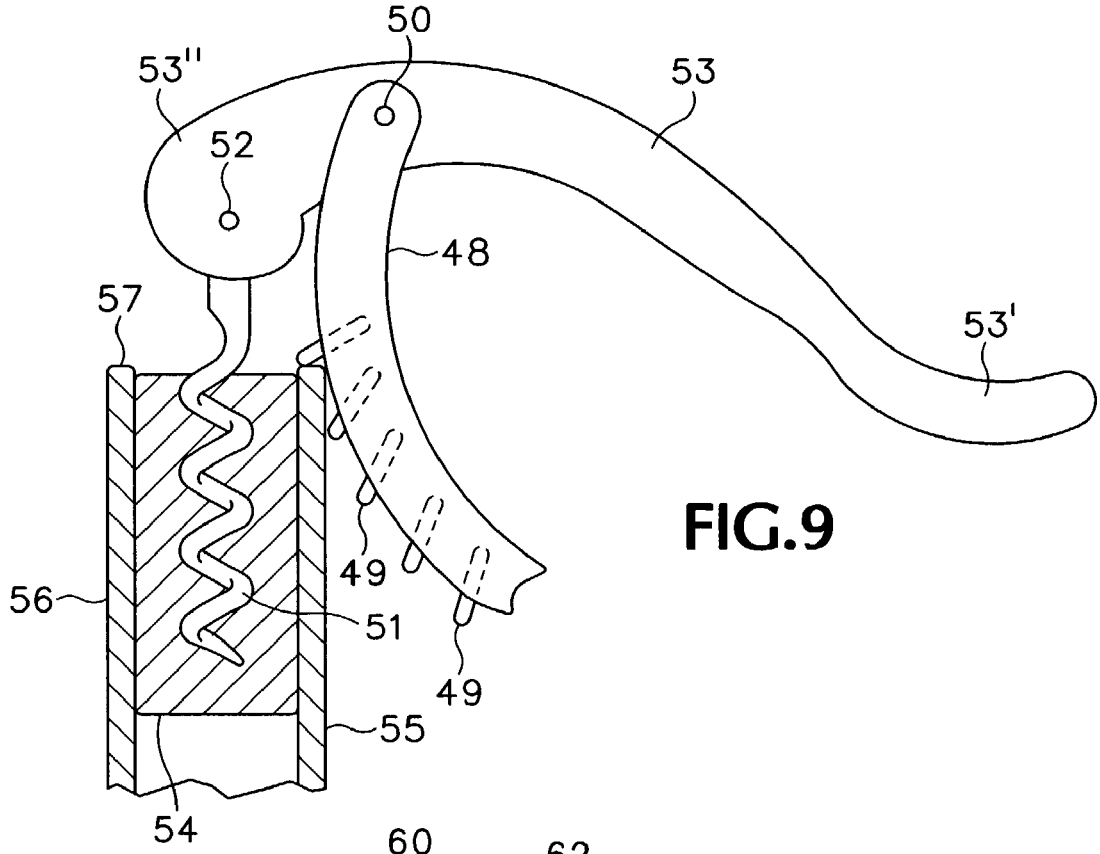
FIG. 9 is a side view of another embodiment of a corkscrew of this invention having a single fulcrum with multiple bottle lip-engaging seats providing for different functional lengths of the single fulcrum.

FIG. 9 is another embodiment of the corkscrew of this invention where a single fulcrum (48) has multiple bottle lip-engaging seats (49) for selective engagement with a bottle lip (57) as desired. A cork-engaging screw (51), pivotally mounted (52) to screw end (53") of a lever (53), is driven into a cork (54) in a bottle (55). The operator then engages the fulcrum (48), that is pivotally mounted (50) to the lever (53) between the screw end (53") and the free end (53'), by placing one of the seats (49) on the bottle lip (57) so that the free end (53') and the bottle neck (56) are within the grasp of a single hand similar to FIG. 2 when the corkscrew apparatus is engaged for use. Multiple squeezing operations are made possible by the multiple seats (49) on the fulcrum (48). This, along with the shape of the lever (53) allows the free end (53') and the bottle neck (56) to be within the grasp of a single hand and to remove the cork (54) as described previously for other embodiments.

Figure 10:
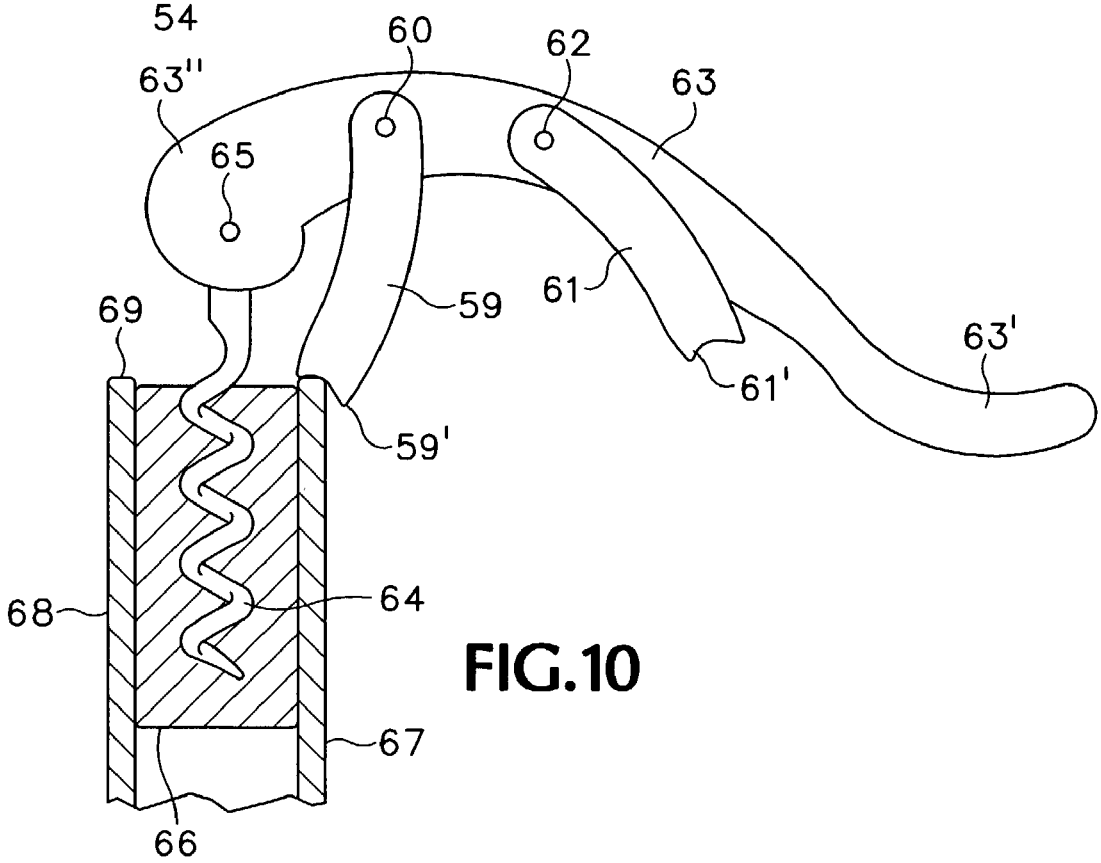
FIG. 10 is a side view of another embodiment of a corkscrew of this invention having two fulcrums that are mounted at different places along the corkscrew lever.

FIG. 10 is another embodiment of the invention in which a plurality of fulcrums (59) and (61), are pivotally mounted to lever (63) between a screw end (63") and a free end (63') on separate pivot mounts (60) and (62) respectively. Their lengths then need not be so disparate as in the original embodiment FIG. 1. A cork-engaging screw (64), pivotally mounted (65) on the screw end (63") of lever (63), is driven into a cork (66) in a bottle (67). Fulcrum (59), which is mounted closer to the screw end (63") than fulcrum (61), is engaged by its free end (59') with the bottle lip (69) for the first squeezing operation. Again its position and length are designed so that the free end (63') and the bottle neck (68) are within the grasp of a single hand, similar to FIG. 2. An initial squeeze will bring the free end (63') against the bottle neck (68) and the cork (66) will be lifted an initial distance. The operation is repeated with fulcrum (61) engaged by its free end (61') with the bottle lip (69). This again places bottle neck (68) and free end (63') within the grasp of a single hand. The free end (63') of lever (63) is again brought against the bottle neck (68) with the squeeze of the single hand, and the cork (66) is removed. The plurality of fulcrums in this embodiment do not need to be limited to two.

Figure 11:
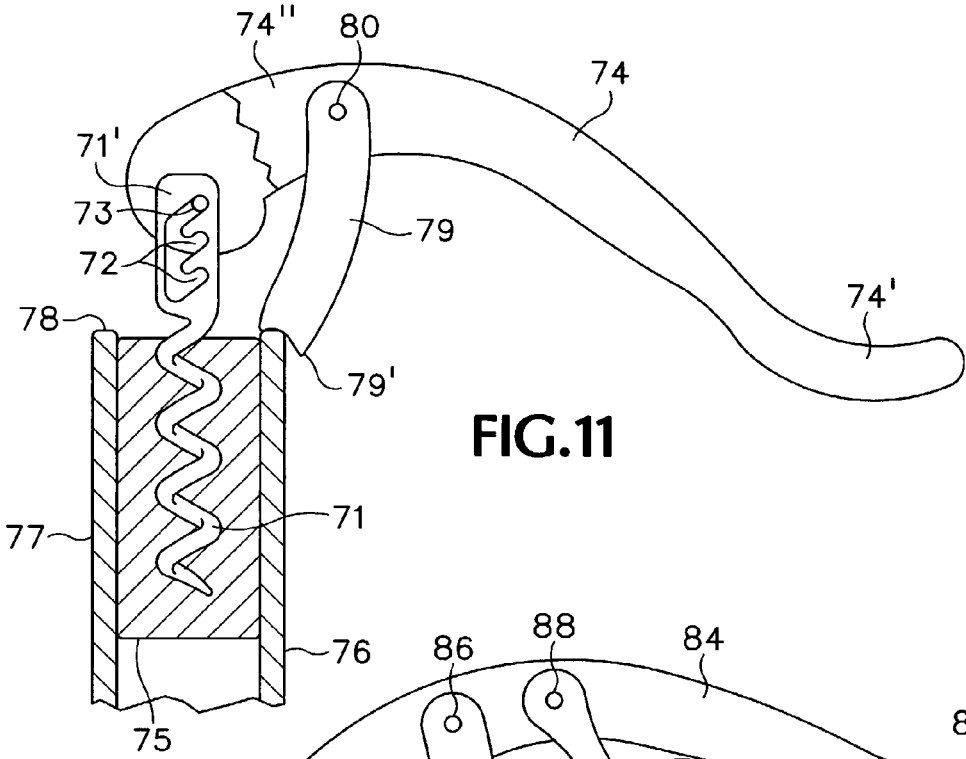
FIG. 11 is a side view of another embodiment of a corkscrew of this invention having a screw that is adjustably pivotally mounted to the lever.

FIG. 11 illustrates another embodiment of the invention in which the shank (71') of screw (71) is elongated and has multiple pivotal attachment points (72) that adjustably and pivotally mount the screw (71) by a pivot mount (73) to the screw end (74") of a lever (74). The screw (71) is engaged within a cork (75) in a bottle (76); fulcrum (79), that is pivotally mounted (80) on lever (74) between the screw end (74") and the free end (74'), is seated by its free end (79') on the bottle lip (78). A first pivotal attachment point (72) of the screw (71) is chosen so that free end (74') and bottle neck (77) are within the grasp of a single hand similar to FIG. 2. A first squeeze brings the free end (74') to the bottle neck (77). The lever (74) is repositioned by choosing a second pivotal attachment point (72) that will again place the free end (74') and the bottle neck (77) within the grasp of one hand. The squeezing operations are repeated in this manner until the cork (75) is removed from the bottle neck (77).

Figure 12:
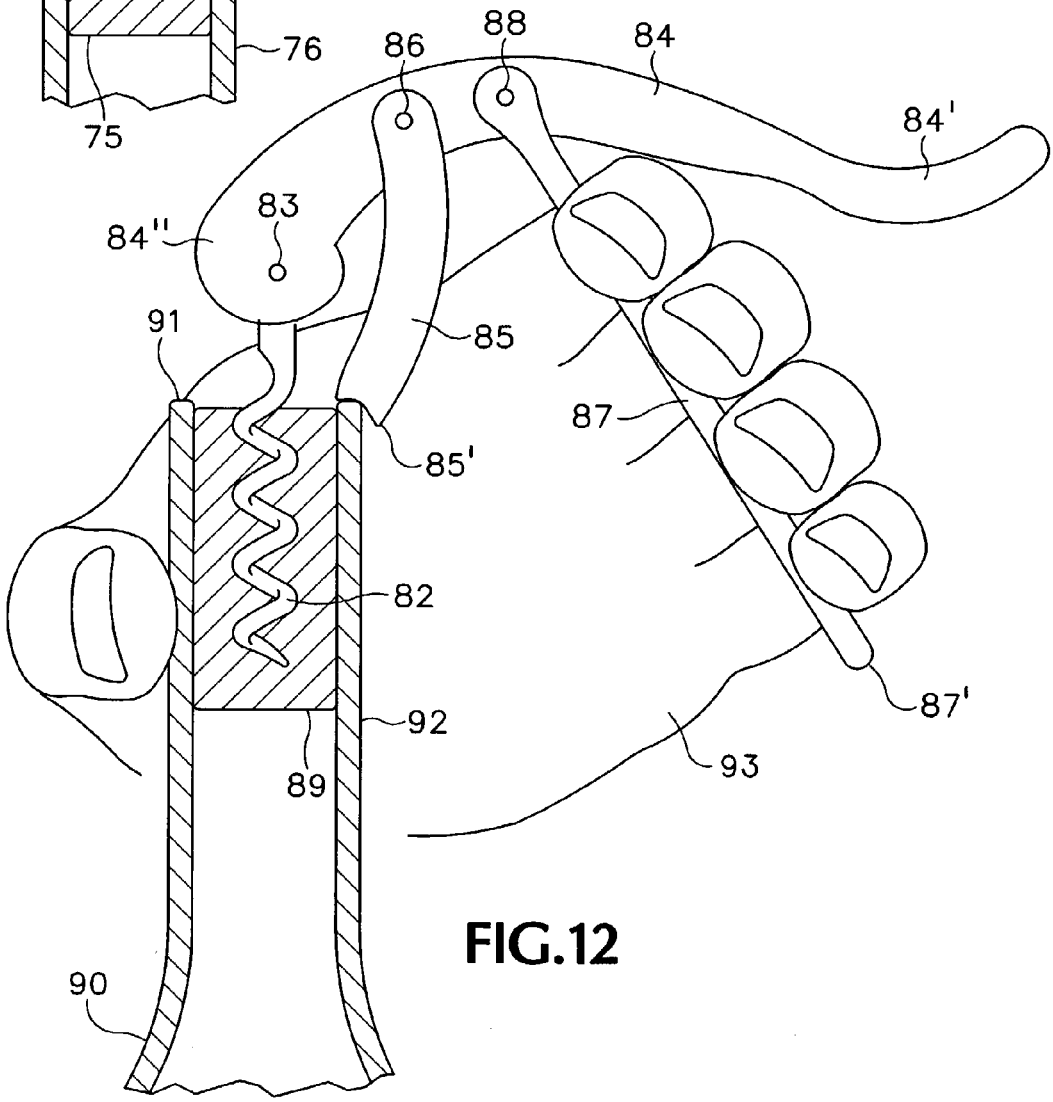
FIG. 12 is a side view of another embodiment of a corkscrew of this invention with an accessory lever.

FIG. 12 is another embodiment of the invention in which a cork-engaging screw (82) is pivotally mounted (83) to a screw end (84") of a lever (84), and a single fulcrum (85) is pivotally mounted (86) to lever (84) between screw end (84") and free end (84'). An accessory lever (87) is pivotally mounted (88) to lever (84) intermediate pivot mount (86) and free end (84') so that its free end (87') can abut free end (84'). After the screw (82) is driven into the cork (89) and the fulcrum (85) is seated by its free end (85') against the bottle lip (91), the accessory lever (87) is able to rotate down from lever (84) towards the bottle neck (92). This rotation is limited by a predetermined amount, to place the bottle neck (92) and the accessory lever (87) within the range of a grip of a single hand (93). A first squeeze will bring the accessory lever (87) against the bottle neck (92) while lifting the cork (89) an initial distance out of the bottle neck (92). This now places the bottle neck (92) and free end (84') of lever (84) within the grasp of the single hand (93). Fulcrum (85) can remain seated on the bottle lip (91) while the operator repositions their hand to hold the free end (84'). A second squeezing operation will bring the free end (84') to the bottle neck (92) while the accessory lever (87) will be pivoted back onto the lever (84) toward the free end (84') and not interfere with the operation of the corkscrew. The cork (89) will now be lifted its final distance and extracted from the bottle neck (92).

I claim:

1. An apparatus to extract a stopper from a bottle, comprising:

an insertion element to engage with the stopper, the insertion element mounted via an insertion element pivot point; and at least one fulcrum coupled between the insertion element pivot point and an area of a lever where the lever is to be grasped by a hand;

the lever and the at least one fulcrum formed to enable a single hand grasping the lever and a neck of the bottle to squeeze the lever toward the neck of the bottle when the at least one fulcrum is secured against a lip of the bottle and the insertion element is substantially fully engaged with the stopper and the stopper is substantially fully inserted in the bottle.

2. The apparatus of claim 1, the lever and the at least one fulcrum formed to enable a substantial squeezing force on the lever toward the neck of the bottle, without substantial force on the lever parallel to the neck of the bottle, when the hand is positioned so that a thumb of the hand grasps the neck of the bottle and at least one fingers of the hand grasp the lever.

3. The apparatus of claim 1, further comprising:

the lever and the at least one fulcrum formed to cause, when the at least one fulcrum is secured against the lip of the bottle and the insertion element is substantially fully engaged with the stopper and the stopper is substantially fully inserted in the bottle, an obtuse angle between (a) a line connecting the insertion element pivot point and a point where the at least one fulcrum is coupled to the lever, and (b) the neck of the bottle.

4. An apparatus to extract a stopper from a bottle, comprising:

an insertion element to engage with the stopper, the insertion element mounted via an insertion element pivot point, and at least one fulcrum coupled between the insertion element pivot point and an area of a lever to be grasped by a band;

the lever and the at least one fulcrum formed to enable a single hand grasping the lever and a neck of the bottle to squeeze the lever toward the neck of the bottle in a manner resulting in an extracting force by the insertion element on the stopper, when the at least one fulcrum is secured against a lip of the bottle and the insertion element is substantially fully engaged with the stopper and the stopper is fully inserted in the bottle.

5. The apparatus of claim 4, further comprising:

the lever and the at least one fulcrum formed to enable, when the insertion element is substantially fully engaged with a fully inserted stopper and when the at least one fulcrum is engaged with a lip of the bottle, the bottle neck and the lever to be grasped simultaneously by the single hand and to enable a stopper extracting force to be generated by an oppositional inward squeeze of the lever toward a neck of the bottle by a thumb and fingers of the hand.

6. An apparatus to extract a stopper from a bottle, comprising:

an insertion element to engage with the stopper, the insertion element mounted via an insertion element pivot point; and at least one fulcrum coupled between the insertion element pivot point and an area of a lever to be grasped by a hand;

the at least one fulcrum and lever formed to provide a capability for a single hand to squeeze the lever toward a neck of the bottle without requiring substantial pressure on the lever in a direction parallel with the neck of the bottle, when the at least one fulcrum is secured against the lip of the bottle and the insertion element is substantially fully engaged with a stopper of the bottle and the stopper is substantially fully inserted in the bottle.

7. The apparatus of claim 6, further comprising:

the lever forming, relative to a point where the at least one fulcrum engages the lip of the bottle, a convex curve at the area of the lever where the lever is to be grasped by the hand, and the lever forming, relative to the point where the at least one fulcrum engages the lip of the bottle, a concave curve from the insertion element pivot point to the area of the lever where the lever is to be grasped by the hand.

8. The apparatus of claim 6, further comprising:

a line connecting the insertion element pivot point and a point of attachment of the at least one fulcrum to the lever forming an obtuse angle with the neck of the bottle when the at least one fulcrum is secured against the lip of the bottle and the insertion element is substantially fully engaged with a stopper of the bottle and the stopper is substantially fully inserted in the bottle.

* * * * *